US006516902B1

(12) United States Patent
Klemm

(10) Patent No.: US 6,516,902 B1
(45) Date of Patent: Feb. 11, 2003

(54) DIRECTIONAL DRILLING SYSTEM

(76) Inventor: Gunter W. Klemm, Gray 21, A-9572 Deutsch-Griffen (AT)

( * ) Notice: Subject to any disclaimer, the term of this patent is extended or adjusted under 35 U.S.C. 154(b) by 188 days.

(21) Appl. No.: 09/672,199

(22) Filed: Sep. 28, 2000

(30) Foreign Application Priority Data

Sep. 29, 1999 (DE) ..... 199 46 587

(51) Int. Cl.[7] ..... E21B 4/14; E21B 7/04
(52) U.S. Cl. ..... 175/296; 175/61; 175/75
(58) Field of Search ..... 175/61, 62, 293, 175/73, 75, 296

(56) References Cited

U.S. PATENT DOCUMENTS

| | | | | |
|---|---|---|---|---|
| 3,552,500 A | * | 1/1971 | Peterson | 173/105 |
| 4,043,409 A | | 8/1977 | Walter | |
| 4,858,704 A | | 8/1989 | McDonald et al. | |
| 5,407,021 A | * | 4/1995 | Kane et al. | 175/296 |
| 5,791,419 A | | 8/1998 | Välisalo | |
| 5,937,954 A | | 8/1999 | Püttmann et al. | |
| 6,138,775 A | | 10/2000 | Püttmann | |
| 6,227,310 B1 | * | 5/2001 | Jamieson | 166/113 |

FOREIGN PATENT DOCUMENTS

| | | |
|---|---|---|
| AT | E 18 284 B | 7/1986 |
| DE | 25 12 784 B2 | 12/1976 |
| DE | 3814939 | 1/1990 |
| DE | 197 25 052 C2 | 6/1997 |
| DE | 196 12 902 A1 | 10/1997 |
| EP | 0 096 639 B1 | 6/1983 |
| EP | 0 195 559 A1 | 3/1986 |
| EP | 0 209 217 | 1/1987 |
| WO | 99/19596 | 4/1999 |

* cited by examiner

*Primary Examiner*—David Bagnell
*Assistant Examiner*—Jennifer R Dougherty
(74) *Attorney, Agent, or Firm*—Choate, Hall & Stewart

(57) ABSTRACT

Disclosed is a device for directional drilling including a drill head mounted on a drill column. A driving device applies an axial driving force to the drill column. A delivery device supplies a wash medium to the drill head through a channel in the drill column. The device provides for increased removal of material and drilling through hard materials by by providing a housing on the drill head having a receptacle for an axially movable piston and a piston drive for producing strikes of the piston acting on the drill head. A connecting link permits an axial movement between the drill head and the drill column. A channel for the wash medium may be sealed at least with respect to the end faces of the piston.

57 Claims, 3 Drawing Sheets

DIRECTIONAL DRILLING SYSTEM

BACKGROUND

1. Field of the Invention

This application generally relates to drilling, and more particularly to a method and apparatus for directional drilling.

2. Description of Related Art

For many years, directional drilling has been a cost efficient and less complex alternative to traditional methods of laying pipelines and tubing in open construction. In directional drilling, a special drill head with a guidance piece is used to produce a pilot hole. The guidance piece may be formed either by an end face of the drill head inclined to the axial direction of the drill head or by a guide body bent at a small angle (less than 5°) in the axial direction of the drill head behind the drill head. Due to the inclined face or the bend in the guide body, the drilling produced with this drill head runs along a circular line with a large radius of curvature. The order of magnitude of the radius of curvature may be, for example, more than 10 meters, or with long drillings, may be more than 100 meters.

The drill column carrying the drill head may be rotated about its longitudinal axis during the forward advance. In this way, the orientation of the inclined surface of the drill head and the bend of the guide piece, and thus the plane of curvature, may be altered. The course of the drilling may be controlled by altering the plane of curvature.

The pilot drill head may include a magnetic probe with which the position of the drill head may be determined accurately. Passive probes may be used at drilling depths of less than fifteen meters in which their positions may be monitored by a monitoring system at the earth's surface. At greater drilling depths, active probes may be used. Active probes may be supplied with electric power over an electric connection line running in the drill column. Signals may be exchanged with the monitoring system at the earth's surface over this line. The position of the drill head may be known by means, for example, such as these probes, so that the course of drilling may be controlled accurately by rotating the drill head about its axis.

Setting and maintaining a certain angle of rotation of the drill column may be essential for controlling the course of drilling. Thus, it is not usually possible to apply rotational movements with the drill column to the drill head to increase drilling capacity. Material removed in producing the pilot hole may be carried away primarily by a wash fluid to which a mud forming additive, such as bentonite in particular, is added. The wash fluid comes out of fluid nozzles in the drill head at a high pressure, such as 100 bar. To increase the capacity for removing cut material, rotation of the drill head may be induced through the wash fluid by means of a turbine-like drive, also known as a mud motor, in particular when a bent or angled control element is used behind the drill head for the control. The wash fluid may also provide support for the pilot hole due to the admixed bentonite while also lubricating the drill column. Bentonite mixed with water may have a pasty gelatinous consistency and therefore may reduce friction on the drill column arranged behind the drill head in the pilot hole.

The axial advance of the drill head may be produced by a driving device at the point of entry of the drill head into the ground, exerting a compressive force on the drill column. Despite the wash fluid (also called a supporting fluid) in the pilot hole, there may be considerable friction on the drill column, in particular with lengthy drilling, such as with distances of more than 100 meters. Therefore, a limited axial pressure may be applied to the drill head over the drill column. Because of the limited axial pressure that may be transferred over the drill column, it may be possible to a limited extent to drill by breaking rocks, for example, by means of drill bits on the drill head that are in contact with the material to be removed with an axial pressure and remove this material because of movements of the drill head. Even with drill heads having a rotational drive, the removal of material may take place mainly through a high-pressure supply of the wash fluid and to a limited extent through the mechanical action of drill bits, such as a rotary cutter. Thus, in producing pilot holes, it is may be difficult to penetrate through harder materials, such as for example, in areas of rock and gravel.

After producing the pilot hole, the drill head coming out of the exit hole of the drilling may be removed from the drill column. It may be necessary to widen the diameter of the hole. To accomplish this, an enlargement bit mounted on the drill column may advanced by the drill column through the pilot hole, for example, by means of the driving device, enlarging the diameter in the process. The wash fluid or supporting fluid also supplied to the enlargement bit under pressure through the channel in the drill column may be responsible for removing most of the material. When working with an enlargement bit, the drill head of the enlargement bit may also be set in rotational motion by the drill column. A supporting pipe which supports the drilling with an expanded diameter may be mounted on the rear end of the head of the enlargement bit. The supporting pipe may also be formed by the pipe which is actually to be laid. The supporting pipe may be pulled passively through the hole due to the force applied to the drill column by the driving device.

SUMMARY OF THE INVENTION

In accordance with principles of the invention is a device for directional drilling which increases removal of material and drilling through hard materials. This may be achieved according to this invention by providing a housing between the drill column and the drill head having a receptacle for an axially movable piston and a piston drive to generate strokes of the piston acting on the drill head. A connecting link permits an axial movement between the drill head and the drill column and the channel for the wash medium is sealed at least with respect to the end faces of the piston.

The term "drill head" refers to the part which is in contact at an axial end face with the material to be removed. Axial strokes on the drill head are generated by the axially movable piston in the housing, producing a brief increase in surface pressure between the drill head and the material to be removed. The teeth and tips also provided on traditional drill heads for directional drilling remove larger amounts of material, especially hard material, due to the stroke. The efficiency in removal of material is increased greatly by the percussion mechanism. A connecting link provides for axial movements between the drill head and the drill column transmitting the axial force. In the absence of such a connecting link, strikes would be applied to the drill column mounted on the drill head in addition to the end face of the drill head. Consequently, this would reduce the impact energy for removal of material, because the drill column, which may be several hundred meters long, and the drill head would have to be accelerated together. Additionally, the risk of damage to the drill column would be increased.

The fact that the channel for the wash medium may be separated at least from the end faces of the piston may be taken into account. A wash medium, in particular a supporting medium consisting of bentonite mixed with water flowing around the piston at the end face may prevent a rapid axial movement of the piston. When creating the pilot hole in which a drill column is connected to one side of the drill head, the wash fluid may be transported to the drill head exclusively axially through this drill column. In this case, special measures may be taken to prevent the wash fluid from entering the spaces bordering the end faces of the piston. On the peripheral face of the piston, the wash fluid may optionally flow around it because the wash fluid here may not interfere with the axial movement of the piston. Thus, for example, the wash fluid may be used to induce a rotational movement in the piston at its peripheral face. However, it is also possible to completely separate the wash fluid channel from the piston receptacle by creating one or more separate drillings for the wash fluid in the housing. Finally, a pipe may pass through the piston to transport the wash fluid to the drill head.

Such a supply of wash fluid through the housing for the percussion mechanism may be useful when creating the pilot hole. If the diameter is to be increased by pulling the enlargement bit through the pilot hole by means of the drill column, the percussion mechanism may be mounted on the end opposite the drill column. In this case, the drive for the piston may be provided through the supporting pipe. As an alternative, the supporting fluid may also be supplied through the supporting pipe and the drive supplied with a drive fluid, for example, through the drill column.

Deep-hole hammer drills having an axially movable piston in a housing acting on a cutter (such as a trepan, chisel bit, and the like), the drill head, held in the housing in a rotationally fixed but axially movable position may be found, for example, in European Patent Application EP 96,639 A1. However, there has been a prejudice against a similar design of a directional drilling device, in particular because embodiments may need to supply the wash fluid or supporting fluid through the drill column. The known deep-hole hammer drills are used in drilling straight holes where the drill column has a channel for supplying scavenging air. The scavenging air has an extremely low viscosity even at a high pressure and therefore does not prevent free movement of the axially movable piston. It may be also used as a drive medium for the piston.

In directional drilling, the wash medium generally consists of the supporting fluid with water and a high concentration of bentonite. This type of mud medium greatly impairs the free axial movement of the piston and thus seemed to prevent use of a percussion mechanism. Furthermore, there did not seem to be any need for a percussion mechanism because the material is removed essentially by the wash medium.

The present invention, which may include separating the end faces of the piston perpendicular to the axial movement from the wash medium and recognizes the weaknesses of the directional drilling method when working with harder materials, eliminates the difficulties associated with a percussion mechanism with directional drilling devices.

It may be difficult to drive the piston in the present case with the wash medium because of the gelatinous pasty consistency of the wash medium. An embodiment may include having the wash medium flow around the peripheral surface of the piston in the axial direction causing a rotational movement of the piston by acting on guide ribs arranged on the peripheral surface which act as blades on a turbine impeller. The piston may rotate in the housing with one contact face on a ramp face of the receptacle, with the ramp face extending in the peripheral direction and also obliquely to the radial plane of the housing. Thus, the piston which is driven to rotation may be pushed axially away from the drill head. The rear end face of the piston may be supported against a spring element (e.g. steel spring or a spring action gas cushion), so that at the end of the ramp face the piston is driven forward by the spring force in the direction of the drill head.

As an alternative, the supporting fluid may be kept completely away from the piston. In this case, a different drive may be used for the striking or percussion movements of the piston. An electric piston drive may be used and may be advantageous, especially with a drill head having an active probe which may, for example, use a power supply over a power supply cable. The piston may be designed as an armature and the housing surrounding the piston as a stator of an electric motor. The piston may also be supported by a ratchet in the axial direction. The piston may be driven electrically to rotational motion, which is converted by the ratchet and the rear spring into striking movements. The percussion mechanism may be operated by an electric drive independently of the supply of wash fluid. When drilling through soft layers of soil, removal of material may be accomplished using the wash medium. As soon as harder strata are reached, the percussion drive may be activated in an embodiment.

In an embodiment of the invention in which a second drill column or pipe is mounted on the drill head opposite the drill column, the wash fluid may be supplied through one of the columns and the drive power for the percussion mechanism may be supplied through the other.

An embodiment of the invention may include other drive options that are also conceivable for the piston (e.g. hydraulic or pneumatic drives).

When creating the pilot hole, the drill head may have a probe to determine the position of the drill head. An embodiment of the invention may include a probe arranged behind the receptacle for a piston in the housing in order to minimize damage by strikes of the piston.

An embodiment may include a connecting link to permit axial movement between the drill head and the drill column that may be created by a star-shaped driving profile on a shaft which is connected to the drill head, being held so that it is axially displaceable in a star-shaped recess with a plurality of axially extending grooves in the housing. This results in a form-fitting connection in the peripheral direction, reliably transmitting rotational movements of the housing to the drill head. Free mobility of the drill head with respect to the housing may exist in an embodiment of the invention in the axial direction and may be preferably limited by end stops. During drilling, an axial displacement path of the drill head by a few centimeters may be sufficient to completely transfer the striking energy of the hammer to the base of the drilling.

Such a connecting link may be used to create the pilot hole where the drill column applies a pushing force to the drill head as well as to create the expanded diameter, where the drill column pulls on the enlargement bit. The strikes of the piston may support the advancing action of the drill column and produce small displacements of the drill head in the direction of its free-running with respect to the drill column.

If a second drill column or pipe is pulled or pushed passively through the drill hole by the drill head, an embodiment may also include an elastically deformable damping element for damping the axial forces between the drill head and this passively moving drill column. In this case, the drill head pulls or pushes the drill column in the direction of advance. The strikes of the piston act in the same direction, so that undamped contact between the drill head and the drill column which is pulled or pushed would lead to direct transfer of the piston strikes into this drill column.

The housing of the device according to the present invention having the piston may also at the same time form the control element for controlling the direction of advance of the drill head. In this case, this housing may be designed with a curvature or angle in the longitudinal direction.

The drill head itself may be designed as a guidance head with an inclined face and the housing may be straight. As mentioned above, the device according to the present invention may also be provided with a rotational drive for the drill head itself, preferably driven by the wash medium. Such a rotating drill head may be provided with a curved housing as the guidance element, leading, when combined with the percussion mechanism according to the present invention, to a high-quality rotary percussion drill which represents an innovation in directional drilling and may also result in a considerable increase in capacity.

In accordance with another aspect of the invention is a device for directional drilling. It includes a drill head mounted on a drill column. A driving device applies an axial driving force to the drill column. A delivery device supplies a wash medium to the drill head through a channel in the drill column. A housing arranged on the drill head has a receptacle for an axially movable piston drive for producing strikes of the piston on the drill head. A connecting link permits an axial movement between the drill head and the drill column. The channel for the wash medium is sealed at least with respect to end faces of the piston.

In accordance with yet another aspect of the invention is a device for directional drilling. A drill head is mounted on a drill column. A driving device applies an axial driving force to the drill column. A delivery device supplies a wash medium to the drill head through a channel in the drill column. A housing arranged on the drill head and having a receptacle for an axially moveable piston and a piston drive to produce strikes of the piston acting on the drill head.

In accordance with yet another aspect of the invention is a device for enlarging a pilot hole. A drill head is mounted on a drill column and has an annular working surface. A supporting pipe is mounted on the drill head opposite the drill column. A driving device applies an axially driving force to the drill column. A housing is arranged on the drill head and has a receptacle for an axially moveable piston and a piston drive that produces strikes of the piston acting on the drill head.

In accordance with yet another aspect of the invention is a device for directional drilling. A drill column is mounted on a drill head. A channel is arranged in the drill column that supplies a wash medium to the drill head. Means for connecting the drill head to the drill column permits a relative movement of the drill head to the drill column along a longitudinal axis of the drill head. Pressure means provides a pressure on the drill head being movably arranged along the longitudinal axis and having at least two faces. One of the faces is arranged on the pressure means in a direction to the drill head. The other one of the faces is arranged on the pressure means in the opposite direction to the drill head. At least one sealing seals the faces with respect to the channel.

BRIEF DESCRIPTION OF THE DRAWINGS

Features and advantages of the present invention will become more apparent from the following detailed description of exemplary embodiments thereof taken in conjunction with the accompanying drawings in which.

DETAILED DESCRIPTION OF PREFERRED EMBODIMENT(S)

Figure 1:
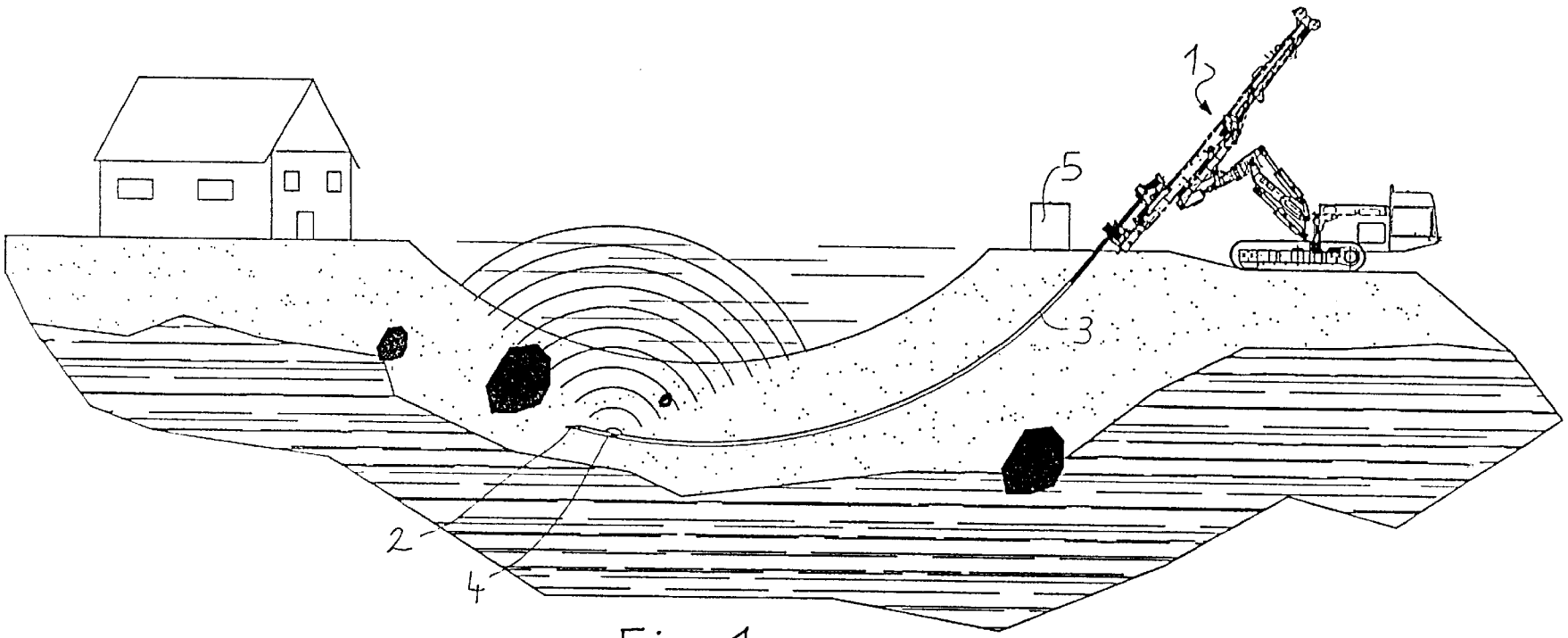
FIG. 1 is an example of a schematic diagram of a device for performing directional drilling.

Referring to FIG. 1, shown is an example of a schematic diagram of a device for performing directional drilling. To produce a pilot hole, a drill head 2 is driven into the earth at an angle by a driving device 1 by means of a drill column 3. Near drill head 2 is arranged a probe 4. Probe 4 may be a magnetic probe which makes it possible to determine the precise position of drill head 2 by means of a navigation system and a monitoring unit. A driving device 1 may include a rotational device with which drill column 3 is driven to rotate about its longitudinal axis and may be locked in a certain angular position. In this way, the plane of the radius of curvature of the resulting drilling may be inclined in any desired direction. The drilling may thus be guided in any direction mostly parallel to the earth's surface. The drilling may in particular be guided from a point of entry into the earth to an exit opening with a large radius of curvature, as shown in FIG. 1, for example, so that obstacles such as buildings, ground water or traffic areas may be overcome without requiring open construction.

Also included in the embodiment shown in FIG. 1 is a pump and mixing unit 5 for a supporting fluid, for example, consisting of a mixture of bentonite and water, that may be connected to drill column 3. The supporting fluid which may be supplied to drill column 3 under high pressure comes out of fluid nozzles in drill head 2.

After finishing the pilot hole, drill head 2 which has come out of the exit opening of the hole is removed from drill column 3. Subsequently, an enlargement bit may be mounted on drill column 3 and may be pulled through the pilot hole with drill column 3. A column or supporting pipe mounted on the end opposite the drill column may be pulled through the enlarged borehole. If needed, the diameter of the hole may be further increased by using additional enlargement bits which are alternately pulled and pushed through the hole by the drill column by, for example, means of driving device 1.

With drill head 2 illustrated here as well as with an enlargement bit which is not shown in FIG. 1, most of the material may be removed during drilling by the medium coming out of the fluid nozzles of drill head 2.

FIGS. 2 through 5 show four different embodiments of drill heads according to the present invention. The embodiment of FIG. 2 includes the front end of drill column 3 from FIG. 1 shown with a drill head 2 designed as a guidance shoe. Front end face 6 of drill head 2 is inclined to the radial direction of the drilling to be produced. Two outlet nozzles 7, 8 are shown as an example for the supporting fluid which is supplied to drill head 2 through an axial channel 9 in drill column 3. The medium coming out of outlet nozzle 8 flows along a groove 19 in the surface of drill head 2 and may then distributed in the borehole. Multiple outlet nozzles 7, 8 are distributed around the circumference of drill head 2. End face 6 of drill head 2 also has a hardened drill tip 10.

In this embodiment, the percussion device is connected between drill column 3 and drill head 2. It includes a cylindrical housing 11 accommodating a piston 13 which is axially movable in a receptacle 12. The rear end of housing 11 is connected by a screw connection 14 to drill column 3. Magnetic probe 4 is mounted on drill column 3 in the immediate vicinity of screw connection 14.

Axially movable piston 13 strikes a shaft 15 which is mounted on drill head 2 and projects into housing 11 and through which passes channel 9 for the supporting fluid. Between screw connection 14 on housing 11 and shaft 15, channel 9 is formed by a pipe 16 which is sealed with respect to receptacle 12 for piston 13. Pipe 16 is sealed by sealing rings in the axial bore in housing 11 and in the axial bore in drill head 2. This ensures that the supporting fluid does not penetrate into receptacle 12 for piston 13 and does not interfere with its axial movement. Pipe 16 is axially displaceable in drill head 2 so that the strikes of piston 13 may lead to an axial movement of piston 13. Piston 13 which is held axially displaceably in housing 11 has a through-hole with pipe 16 passing through it, preferably without contact. Thus, no friction on the walls of the pipe may retard axial movement of the piston 13.

Any one of a variety of drives may be used for piston 13, so no drive is shown in the accompanying drawings. A spring element may be preferably arranged on the side of the piston 13 opposite drill head 2. The end face of piston 13 facing drill head 2 is supported on ramp faces running in the peripheral direction. The piston is set in rotational motion by a drive, so that it may be removed from shaft 15 of drill head 2 by sliding over the ramp faces and at the end of the ramp faces strikes against shaft 15 because of the spring force acting axially.

Shaft 15 has a driving profile 17 which has a star-shaped or toothed ring contour in cross section and engages in grooves arranged in a star pattern on the inside circumference of the housing. In this way, drill head 2 may be connected to housing 11 in a rotationally fixed manner to move over a certain distance axially.

Figure 2:
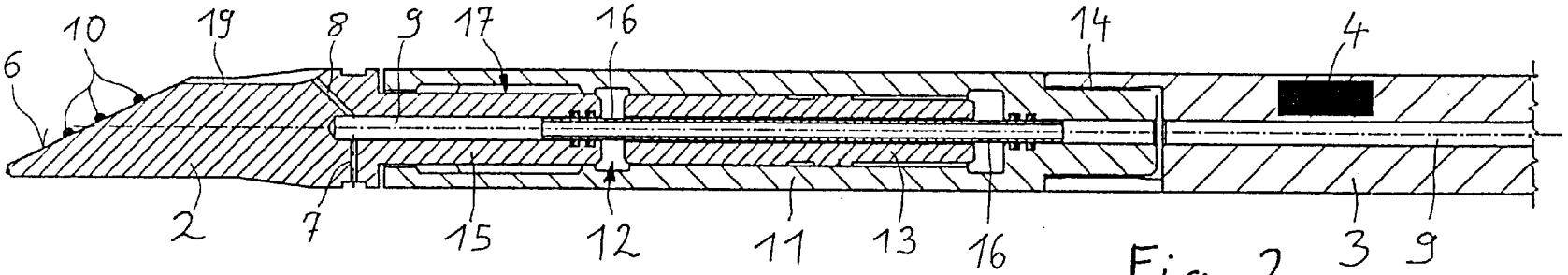
FIG. 2 is an example of a longitudinal section through a first embodiment of a device.
Figure 3:
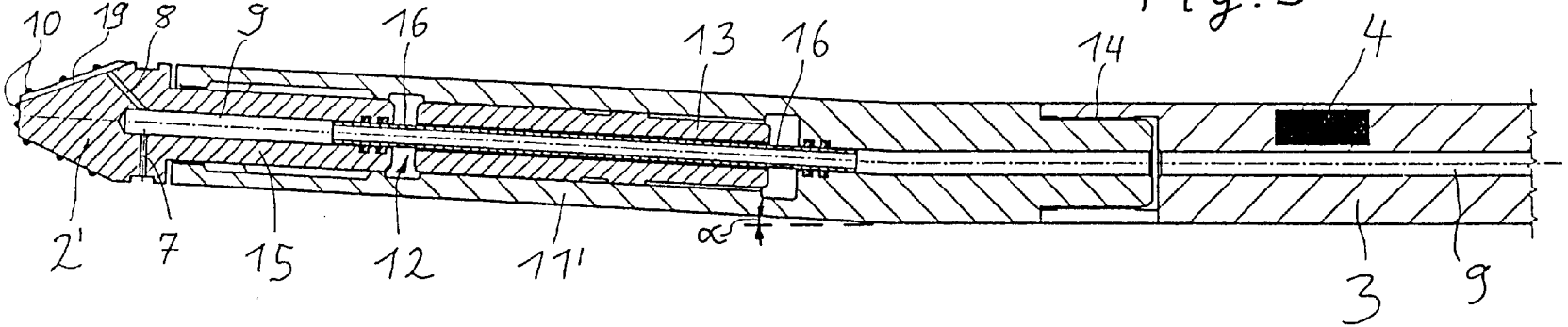
FIG. 3 is an example of a longitudinal section through a second embodiment of a device.

Referring to FIG. 3, shown is an example of a diagram corresponding to FIG. 2 in which housing 11' has a bend in the axial direction by an angle ∀. In the present example as shown in FIG. 3, angle ∀ may be, for example, approximately 3°. Drill head 2' may be designed with rotational symmetry and, like the embodiment described above in connection with FIG. 2, it includes outlet nozzles 7', 8' for the supporting fluid. Additional corresponding parts are labeled with the same reference numbers as that used in FIG. 3.

In particular, a rotational motion of rotationally symmetrical drill head 2' may be induced by a rotational drive device (not shown). An embodiment may include the drill head 2' mounted on the shaft 15 so it can rotate. In another embodiment, the shaft 15 may be mounted so it can rotate within the housing 11'.

Figure 4:
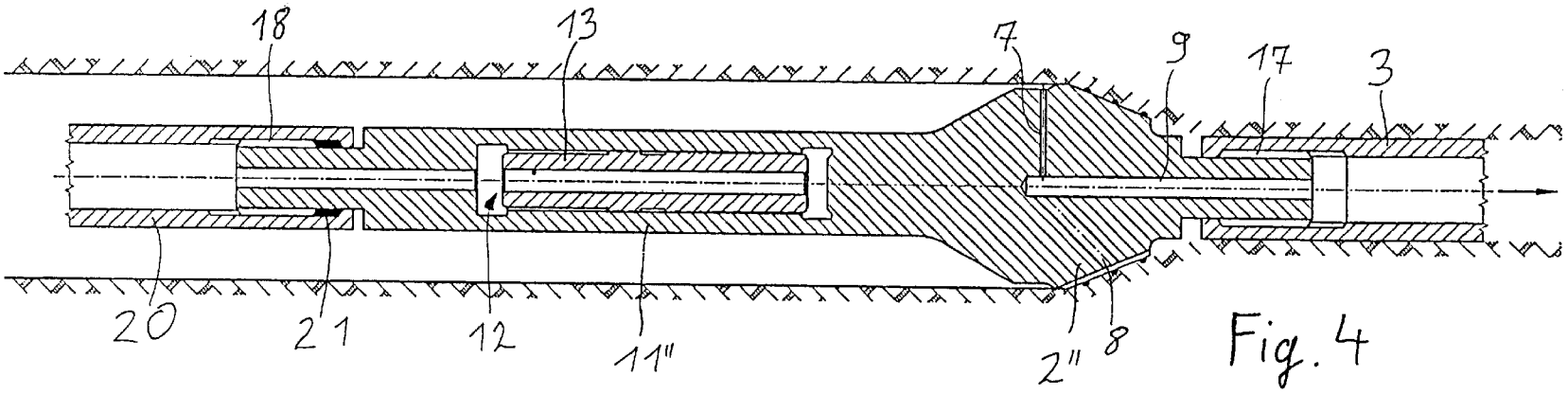
FIG. 4 is an example of a longitudinal section through a third embodiment of a device for producing an enlarged diameter in drilling by pulling the drill head.
Figure 5:
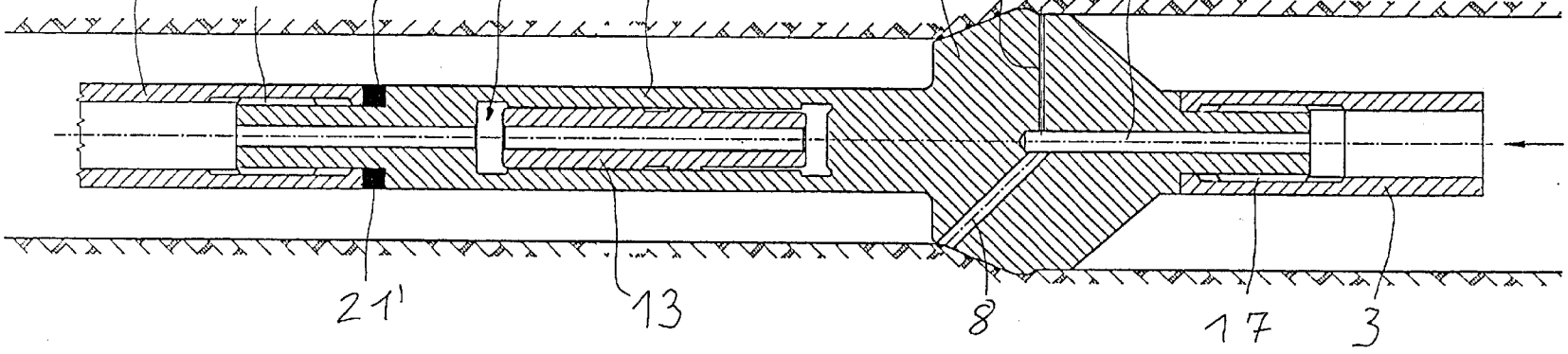
FIG. 5 is an example of a longitudinal section through a fourth embodiment of a device for producing an enlarged diameter in drilling by pushing the drill head.

Additional embodiments of the present invention are shown in FIGS. 4 and 5, where the enlargement bits 2" and 2'" may be mounted on drill column 3 which is connected to the driving device. These bits are pulled through the drill hole on the one hand, and on the other hand, pushed through the drill hole by drill column 3. The enlargement bits 2" and 2'" here are advanced through the pilot hole already created and thus they may not need to be guided. The enlargement bits 2" and 2'" are designed to have rotational symmetry and may be rotated by a rotational drive of the driving device and drill column 3 during drilling.

Drill head 2" from FIG. 4 may be an enlargement bit which cuts the pilot hole to a larger diameter. A wash medium (supporting fluid) may also supplied to enlargement bit 2" through channel 9 in drill column 3 and enters the borehole through outlet nozzles 7, 8 and channels 19.

With enlargement bit 2" pulled by drill column 3, housing 11" with the percussion mechanism is on the side of drill head 2" opposite drill column 3. Another column or a supporting pipe 20 may be connected to housing 11". This column or pipe 20 may support the expanded borehole and may have, for example, an electric cable for the drive for piston 13 of the percussion mechanism. As an alternative, a medium for the piston drive may be supplied through this column. Column 20 is axially movably connected to drill head 2" by a driving profile 18. Since column 20 is pulled passively by drill head 2" and the pulling motion corresponds to the striking action of piston 13, an elastic damping element 21 may be provided to dampen the axial motion between drill head 2" and column 20. Damping element 21 may transmit the tensile force to pull through column 20. With a jolt in acceleration of drill head 2", a relative motion is possible between drill head 2" and column 20, for example, such that no strikes are transmitted to column 20.

The percussion mechanism on enlargement bit 2'" from FIG. 5 functions similarly to that as described in connection with FIG. 4. The enlargement bit 2'" may be pushed as the second expansion step through the borehole after drill head 2" has been pulled through, for example, by means of the driving device and drill column 3. The passive pipe or column 20 may be supported against a damping element 21' with respect to housing 11'" from which it is pushed through the borehole in the direction of advance. Housing 11'" may be arranged in this embodiment with the percussion mechanism in front of drill head 2'" in the direction of drilling and may transmit tensile forces to drill head 2'".

It should be noted that in the foregoing descriptions accompanying the figures, the percussion mechanism produces a percussive pressure on the drill head. The percussion mechanism may include, for example, a piston and a piston drive for producing strikes of the piston on the drill head. This percussive pressure is to be distinguished from means for pushing the drill column through the drill hole.

While the invention has been disclosed in connection with preferred embodiments shown and described in detail, their modifications and improvements thereon will become readily apparent to those skilled in the art. Accordingly, the spirit and scope of the present invention should be limited only by the following claims.

What is claimed is:

1. A device for directional drilling, comprising:

a drill head mounted on a drill column;

a driving device for applying an axial driving force to said drill column;

a delivery device for supplying a wash medium to said drill head through a channel in said drill column;

a housing arranged on said drill head having a receptacle for an axially movable piston and a piston drive for producing strikes of said piston on said drill head, wherein a connecting link permits an axial movement between said drill head and said drill column and said channel for said wash medium is sealed at least with respect to end faces of said piston and wherein said drill head has a ring-shaped working face for widening a pilot hole, and said housing with said receptacle and said drive for said piston is arranged on a side of said drill head opposite said drill column with said channel for said wash medium; and a supporting pipe connected to said housing, wherein said supporting pipe is axially movably connected to said drill head by a connecting link.

2. A device for directional drilling, comprising:

a drill head mounted on a drill column;

a driving device for applying an axial driving force to said drill column;

a delivery device for supplying a wash medium to said drill head through a channel in said drill column;

a housing arranged on said drill head having a receptacle for an axially movable piston and a piston drive for producing strikes of said piston on said drill head, wherein a connecting link permits an axial movement between said drill head and said drill column and said channel for said wash medium is sealed at least with respect to end faces of said piston and wherein said drill head has a ring-shaped working face for widening a pilot hole, and said housing with said receptacle and said drive for said piston is arranged on a side of said drill head opposite said drill column with said channel for said wash medium; and a supporting pipe connected to said housing, wherein said drive for the piston is supplied with power through said supporting pipe.

3. A device for directional drilling, comprising:

a drill head mounted on a drill column;

a driving device for applying an axial driving force to said drill column;

a delivery device for supplying a wash medium to said drill head through a channel in said drill column; and a housing arranged on said drill head having a receptacle for an axially movable piston and a piston drive for producing strikes of said piston on said drill head, wherein a connecting link permits an axial movement between said drill head and said drill column and said channel for said wash medium is sealed at least with respect to end faces of said piston, and wherein said piston drive produces a rotational movement of said piston, said piston and said receptacle have mutually contacting contact faces, at least one of which has a section running in the peripheral direction and with an inclination toward the radial plane of said housing and a section following said running essentially axially, and an end face of said piston opposite the contact faces is supported against a spring element.

4. A device for directional drilling, comprising:

a drill head mounted on a drill column;

a driving device for applying an axial driving force to said drill column;

a delivery device for supplying a wash medium to said drill head through a channel in said drill column;

a housing arranged on said drill head having a receptacle for an axially movable piston and a piston drive for producing strikes of said piston on said drill head, wherein a connecting link permits an axial movement between said drill head and said drill column and said channel for said wash medium is sealed at least with respect to end faces of said piston; and a probe is provided for said drill head, wherein said probe is arranged in said housing behind said receptacle for said piston in the direction of advance.

5. A device for directional drilling, comprising:

a drill head mounted on a drill column;

a driving device for applying an axial driving force to said drill column;

a delivery device for supplying a wash medium to said drill head through a channel in said drill column;

a housing arranged on said drill head having a receptacle for an axially movable piston and a piston drive for producing strikes of said piston on said drill head, wherein a connecting link permits an axial movement between said drill head and said drill column and said channel for said wash medium is sealed at least with respect to end faces of said piston; and a probe for said drill head, wherein said probe is arranged in said drill column behind said receptacle for said piston in the direction of advance.

6. A device for directional drilling, comprising:

a drill head mounted on a drill column;

a driving device for applying an axial driving force to said drill column;

a delivery device for supplying a wash medium to said drill head through a channel in said drill column; and a housing arranged on said drill head having a receptacle for an axially movable piston and a piston drive for producing strikes of said piston on said drill head, wherein a connecting link permits an axial movement between said drill head and said drill column and said channel for said wash medium is sealed at least with respect to end faces of said piston, said connecting link comprises at least one groove running axially with a projection engaging in it, and wherein said groove and said projection are arranged with one on said housing and the other on said drill head.

7. A device for directional drilling, comprising:

a drill head mounted on a drill column;

a driving device for applying an axial driving force to said drill column;

a delivery device for supplying a wash medium to said drill head through a channel in said drill column; and a housing arranged on said drill head having a receptacle for an axially movable piston and a piston drive for producing strikes of said piston on said drill head, wherein a connecting link permits an axial movement between said drill head and said drill column and said channel for said wash medium is sealed at least with respect to end faces of said piston, said connecting link comprises at least one groove running axially with a projection engaging in it, and wherein said groove and said projection are arranged with one on said housing and the other on one of said drill column.

8. A device for directional drilling, comprising:

a drill head mounted on a drill column;

a driving device for applying an axial driving force to said drill column;

a delivery device for supplying a wash medium to said drill head through a channel in said drill column; and a housing arranged on said drill head having a receptacle for an axially movable piston and a piston drive for producing strikes of said piston on said drill head, wherein a connecting link permits an axial movement between said drill head and said drill column and said channel for said wash medium is sealed at least with respect to end faces of said piston, and wherein said connecting link has an elastically deformable damping element for damping the axial forces between said drill head and said column.

9. A device for directional drilling, comprising:

a drill head mounted on a drill column;

a driving device for applying an axial driving force to said drill column;

a delivery device for supplying a wash medium to said drill head through a channel in said drill column; and a housing arranged on said drill head having a receptacle for an axially movable piston and a piston drive for producing strikes of said piston on said drill head, wherein a connecting link permits an axial movement between said drill head and said drill column and said channel for said wash medium is sealed at least with respect to end faces of said piston, and wherein a longitudinal axis of said housing is one of curved at an angle and bent.

10. The device according to claim 9, wherein said channel for said wash medium is arranged in said housing next to said receptacle for said piston.

11. The device according to claim 9, further comprising:

a pipe passing through said piston forms said channel for said wash medium.

12. The device according to claim 9, wherein said drill head has a ring-shaped working face for widening a pilot hole, and said housing with said receptacle and said drive for said piston is arranged on a side of said drill head opposite said drill column with said channel for said wash medium.

13. The device according to claim 12, further comprising:

a supporting pipe connected to said housing.

14. The device according to claim 9, wherein a fluid drive produces axial striking movements of said piston.

15. The device according to claim 14, wherein said drive fluid for said piston is formed by said wash medium.

16. The device according to claim 9, wherein an electric drive produces axial striking movements of said piston.

17. The device according to claim 9, wherein a probe is provided for said drill head.

18. The device according claim 17, wherein said probe is magnetic.

19. The device according to claim 9, wherein said connecting link comprises at least one groove running axially with a projection engaging in it.

20. The device according to claim 9, further comprising a rotational drive for said drill head.

21. A device for directional drilling, comprising:

a drill head mounted on a drill column;

a driving device for applying an axial driving force to said drill column;

a delivery device for supplying a wash medium to said drill head through a channel in said drill column; and a housing arranged on said drill head having a receptacle for an axially movable piston and a piston drive for producing strikes of said piston on said drill head, wherein a connecting link permits an axial movement between said drill head and said drill column and said channel for said wash medium is sealed at least with respect to end faces of said piston, and wherein said drill head is designed as a guide head with a face running at an inclination to the axial direction.

22. A device for directional drilling, comprising:

a drill head mounted on a drill column;

a driving device for applying an axial driving force to said drill column;

a delivery device for supplying a wash medium to said drill head through a channel in said drill column;

a housing arranged on said drill head having a receptacle for an axially movable piston and a piston drive for producing strikes of said piston on said drill head, wherein a connecting link permits an axial movement between said drill head and said drill column and said channel for said wash medium is sealed at least with respect to end faces of said piston; and a rotational drive for said drill head, wherein the rotational drive for said drill head is driven by said wash medium.

23. A device for directional drilling, comprising:

a drill head;

a drill column mounted on said drill head;

a channel arranged in said drill column that supplies a wash medium to said drill head;

means for connecting said drill head with said drill column, permitting a relative movement of said drill head to said drill column along a longitudinal axis of said drill head;

pressure means for providing a percussive pressure on said drill head being movably arranged along said longitudinal axis and having at least two faces, one of the faces is arranged on said pressure means in a direction to said drill head and the other one of said faces is arranged on said pressure means in the opposite direction to said drill head;

at least one sealing which seals said faces with respect to said channel; and a housing arranged on said drill head, wherein said housing is arranged on the side of said drill head opposite said drill column with said channel for said wash medium.

24. A device for directional drilling, comprising:

a drill head;

a drill column mounted on said drill head;

a channel arranged in said drill column that supplies a wash medium to said drill head;

means for connecting said drill head with said drill column, permitting a relative movement of said drill head to said drill column along a longitudinal axis of said drill head;

pressure means for providing a percussive pressure on said drill head being movably arranged along said longitudinal axis and having at least two faces, one of the faces is arranged on said pressure means in a direction to said drill head and the other one of said faces is arranged on said pressure means in the opposite direction to said drill head;

at least one sealing which seals said faces with respect to said channel;

a housing arranged on said drill head; and a supporting pipe connected to said housing.

25. The device according to claim 24, wherein said supporting pipe is axially movably connected to said drill head by a connecting link.

26. The device according to claim 24, wherein said means for connecting said drill head with said drill column comprise at least one groove running axially with a projection engaging in it, said groove and said projection are arranged with one on said housing and the other on said supporting pipe.

27. The device according to claim 24, wherein said means for connecting said drill head with said drill column has an elastically deformable damping element for damping the axial forces between said drill head and said supporting pipe.

28. A device for directional drilling, comprising:

a drill head;

a drill column mounted on said drill head;

a channel arranged in said drill column that supplies a wash medium to said drill head;

means for connecting said drill head with said drill column, permitting a relative movement of said drill head to said drill column along a longitudinal axis of said drill head;

pressure means for providing a percussive pressure on said drill head being movably arranged along said longitudinal axis and having at least two faces, one of the faces is arranged on said pressure means in a direction to said drill head and the other one of said faces is arranged on said pressure means in the opposite direction to said drill head;

at least one sealing which seals said faces with respect to said channel; and a housing arranged on said drill head, wherein said pressure means are arranged in said housing, said pressure means comprise a piston and a piston drive for producing strikes of said piston acting on said drill head, and wherein said drive for said piston is supplied with power through a supporting pipe connected to said housing.

29. A device for directional drilling, comprising:

a drill head;

a drill column mounted on said drill head;

a channel arranged in said drill column that supplies a wash medium to said drill head;

means for connecting said drill head with said drill column, permitting a relative movement of said drill head to said drill column along a longitudinal axis of said drill head;

pressure means for providing a percussive pressure on said drill head being movably arranged along said longitudinal axis and having at least two faces, one of the faces is arranged on said pressure means in a direction to said drill head and the other one of said faces is arranged on said pressure means in the opposite direction to said drill head;

at least one sealing which seals said faces with respect to said channel; and a housing arranged on said drill head, wherein said pressure means are arranged in said housing, said pressure means comprise a piston and a piston drive for producing strikes of said piston acting on said drill head, and wherein said piston drive is an electric drive producing axial striking movements of said piston.

30. A device for directional drilling, comprising:

a drill head;

a drill column mounted on said drill head;

a channel arranged in said drill column that supplies a wash medium to said drill head;

means for connecting said drill head with said drill column, permitting a relative movement of said drill head to said drill column along a longitudinal axis of said drill head;

pressure means for providing a percussive pressure on said drill head being movably arranged along said longitudinal axis and having at least two faces, one of the faces is arranged on said pressure means in a direction to said drill head and the other one of said faces is arranged on said pressure means in the opposite direction to said drill head;

at least one sealing which seals said faces with respect to said channel; and a housing arranged on said drill head, wherein said pressure means are arranged in said housing, said pressure means comprise a piston and a piston drive for producing strikes of said piston acting on said drill head, said housing comprises a receptacle for said piston, and wherein said piston and said receptacle have mutually contacting contact faces, at least one of said contact faces has a section running in peripheral direction and with an inclination toward a radial plane of said housing and one other section following said running section essentially axially, and an end face of said piston opposite the contact faces is supported against a spring element.

31. The device according to claim 30, wherein said piston drive produces a rotational movement in said piston.

32. A device for directional drilling, comprising:

a drill head;

a drill column mounted on said drill head;

a channel arranged in said drill column that supplies a wash medium to said drill head;

means for connecting said drill head with said drill column, permitting a relative movement of said drill head to said drill column along a longitudinal axis of said drill head;

pressure means for providing a percussive pressure on said drill head being movably arranged along said longitudinal axis and having at least two faces, one of the faces is arranged on said pressure means in a direction to said drill head and the other one of said faces is arranged on said pressure means in the opposite direction to said drill head;

at least one sealing which seals said faces with respect to said channel; and a housing arranged on said drill head, wherein said pressure means are arranged in said housing, said pressure means comprise a piston and a piston drive for producing strikes of said piston acting on said drill head, said housing comprises a receptacle for said piston, and wherein a probe for said drill head is arranged in said housing behind said receptacle for said piston in the direction of advance.

33. The device according claim 32, wherein said probe is magnetic.

34. A device for directional drilling, comprising:

a drill head;

a drill column mounted on said drill head;

a channel arranged in said drill column that supplies a wash medium to said drill head;

means for connecting said drill head with said drill column, permitting a relative movement of said drill head to said drill column along a longitudinal axis of said drill head;

pressure means for providing a percussive pressure on said drill head being movably arranged along said longitudinal axis and having at least two faces, one of the faces is arranged on said pressure means in a direction to said drill head and the other one of said faces is arranged on said pressure means in the opposite direction to said drill head;

at least one sealing which seals said faces with respect to said channel;

a housing arranged on said drill head; and a probe for said drill head, wherein said pressure means are arranged in said housing, said pressure means comprise a piston and a piston drive for producing strikes of said piston acting on said drill head, said housing comprises a receptacle for said piston, and wherein said probe is arranged in said drill column behind said receptacle for said piston in the direction of advance.

35. The device according claim 34, wherein said probe is magnetic.

36. A device for directional drilling, comprising:

a drill head;

a drill column mounted on said drill head;

a channel arranged in said drill column that supplies a wash medium to said drill head;

means for connecting said drill head with said drill column, permitting a relative movement of said drill head to said drill column along a longitudinal axis of said drill head;

pressure means for providing a percussive pressure on said drill head being movably arranged along said longitudinal axis and having at least two faces, one of the faces is arranged on said pressure means in a direction to said drill head and the other one of said faces is arranged on said pressure means in the opposite direction to said drill head;

at least one sealing which seals said faces with respect to said channel; and a housing arranged on said drill head, wherein said means for connecting said drill head with said drill column comprises at least one groove running axially with a projection engaging in it, said groove and said projection are arranged with one on said housing and the other on said drill head.

37. A device for directional drilling, comprising:

a drill head;

a drill column mounted on said drill head;

a channel arranged in said drill column that supplies a wash medium to said drill head;

means for connecting said drill head with said drill column, permitting a relative movement of said drill head to said drill column along a longitudinal axis of said drill head;

pressure means for providing a percussive pressure on said drill head being movably arranged along said longitudinal axis and having at least two faces, one of the faces is arranged on said pressure means in a direction to said drill head and the other one of said faces is arranged on said pressure means in the opposite direction to said drill head;

at least one sealing which seals said faces with respect to said channel; and a housing arranged on said drill head, wherein said means for connecting said drill head with said drill column comprise at least one groove running axially with a projection engaging in it, said groove and said projection are arranged with one on said housing and the other on said drill column.

38. A device for directional drilling, comprising:

a drill head;

a drill column mounted on said drill head;

a channel arranged in said drill column that supplies a wash medium to said drill head;

means for connecting said drill head with said drill column, permitting a relative movement of said drill head to said drill column along a longitudinal axis of said drill head;

pressure means for providing a percussive pressure on said drill head being movably arranged along said longitudinal axis and having at least two faces, one of the faces is arranged on said pressure means in a direction to said drill head and the other one of said faces is arranged on said pressure means in the opposite direction to said drill head; and at least one sealing which seals said faces with respect to said channel, wherein said means for connecting said drill head with said drill column has an elastically deformable damping element for damping the axial forces between said drill head and said drill column.

39. A device for directional drilling, comprising:

a drill head;

a drill column mounted on said drill head;

a channel arranged in said drill column that supplies a wash medium to said drill head;

means for connecting said drill head with said drill column, permitting a relative movement of said drill head to said drill column along a longitudinal axis of said drill head;

pressure means for providing a percussive pressure on said drill head being movably arranged along said longitudinal axis and having at least two faces, one of the faces is arranged on said pressure means in a direction to said drill head and the other one of said faces is arranged on said pressure means in the opposite direction to said drill head;

at least one sealing which seals said faces with respect to said channel; and a housing arranged on said drill head, wherein a longitudinal axis of said housing is curved or bent at an angle.

40. A device for directional drilling, comprising:

a drill head;

a drill column mounted on said drill head;

a channel arranged in said drill column that supplies a wash medium to said drill head;

means for connecting said drill head with said drill column, permitting a relative movement of said drill head to said drill column along a longitudinal axis of said drill head;

pressure means for providing a percussive pressure on said drill head being movably arranged along said longitudinal axis and having at least two faces, one of the faces is arranged on said pressure means in a direction to said drill head and the other one of said faces is arranged on said pressure means in the opposite direction to said drill head; and at least one sealing which seals said faces with respect to said channel, wherein said drill head is designed as a guide head with a face running at an inclination to its longitudinal axis.

41. The device according to claim 40, further comprising a housing arranged on said drill head.

42. The device according to claim 41, wherein said pressure means are arranged in said housing.

43. The device according to claim 42, wherein said pressure means comprise a piston and a piston drive for producing strikes of said piston acting on said drill head.

44. The device according to claim 43, wherein said housing comprises a receptacle for said piston.

45. The device according to claim 44, wherein said channel for said wash medium is arranged in said housing next to said receptacle for said piston.

46. The device according to claim 43, wherein said piston has a cylindrical shape.

47. The device according to claim 43, further comprising:

a pipe passing through said piston forms said channel for said wash medium.

48. The device according to claim 43, wherein said piston drive is a fluid drive producing axial striking movements of said piston.

49. The device according to claim 48, wherein a drive fluid for said fluid drive is formed by said wash medium.

50. The device according to claim 40, wherein said drill head has a ring-shaped working face for widening a pilot hole.

51. The device according to claim 40, further comprising a driving device for applying an axial driving force to said drill column.

52. The device according to claim 40, further comprising a delivery device for supplying said wash medium to said drill head through said channel in said drill column.

53. The device according to claim 40, wherein a probe is provided for said drill head.

54. The device according claim 53, wherein said probe is magnetic.

55. The device according to claim 40, wherein said means for connecting said drill head with said drill column comprises at least one groove running axially with a projection engaging in it.

56. The device according to claim 40, comprising a rotational drive for said drill head.

57. A device for directional drilling, comprising:

a drill head;

a drill column mounted on said drill head;

a channel arranged in said drill column that supplies a wash medium to said drill head;

means for connecting said drill head with said drill column, permitting a relative movement of said drill head to said drill column along a longitudinal axis of said drill head;

pressure means for providing a percussive pressure on said drill head being movably arranged along said longitudinal axis and having at least two faces, one of the faces is arranged on said pressure means in a direction to said drill head and the other one of said faces is arranged on said pressure means in the opposite direction to said drill head;

at least one sealing which seals said faces with respect to said channel; and a rotational drive for said drill head, wherein said rotational drive is driven by said wash medium.

* * * * *